US009977362B2

(12) United States Patent
Toichi

(10) Patent No.: US 9,977,362 B2
(45) Date of Patent: May 22, 2018

(54) IMAGE FORMING APPARATUS THAT APPLIES VOLTAGE TO PRIMARY TRANSFER ROLLER TO DETECT CURRENT FLOWING THROUGH PRIMARY TRANSFER ROLLER

(71) Applicant: KYOCERA Document Solutions Inc., Osaka (JP)

(72) Inventor: Tetsuya Toichi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/404,801

(22) Filed: Jan. 12, 2017

(65) Prior Publication Data

US 2017/0205728 A1 Jul. 20, 2017

(30) Foreign Application Priority Data

Jan. 20, 2016 (JP) ..... 2016-008683

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS

2008/0118259 A1* 5/2008 Yamada ..... G03G 15/1675 399/66
2009/0041495 A1* 2/2009 Ishikawa ..... G03G 15/1675 399/66

FOREIGN PATENT DOCUMENTS

JP 2005-024778 A 1/2005
JP 2008225271 A * 9/2008

* cited by examiner

*Primary Examiner* — Victor Verbitsky
(74) *Attorney, Agent, or Firm* — Studebaker & Brackett PC

(57) ABSTRACT

An image forming apparatus includes a photosensitive drum, a primary transfer roller, first and second voltage applicators, first and second voltage controllers, a current detector, and a charging roller. The first voltage controller controls a voltage applied to the primary transfer roller through the first voltage applicator. The current detector detects a current value of a current flowing through the primary transfer roller. The second voltage controller controls a voltage applied to the charging roller through the second voltage applicator. The second voltage controller causes a voltage having a smaller absolute value than a dark potential of the photosensitive drum to be applied to the photosensitive drum during a transfer voltage control period. During the transfer voltage control period, the first voltage controller causes a voltage to be applied to the primary transfer roller, and the current detector detects the current value.

8 Claims, 11 Drawing Sheets

IMAGE FORMING APPARATUS THAT APPLIES VOLTAGE TO PRIMARY TRANSFER ROLLER TO DETECT CURRENT FLOWING THROUGH PRIMARY TRANSFER ROLLER

INCORPORATION BY REFERENCE

The present application claims priority under 35 U.S.C. § 119 to Japanese Patent Application No. 2016-008683, filed on Jan. 20, 2016. The contents of this application are incorporated herein by reference in their entirety.

BACKGROUND

The present disclosure relates to an image forming apparatus.

A generally known image forming apparatus controls voltage that is applied to a transfer roller based on an active transfer voltage control (ATVC) method.

The image forming apparatus for example detects initial voltage by applying a specific constant current bias from the transfer roller to a photosensitive drum. The image forming apparatus then determines a correction voltage based on the number of printed pages and the detected initial voltage. As a result, the transfer voltage in printing can be appropriately controlled.

SUMMARY

An image forming apparatus according to the present disclosure forms an image on a recording medium. The image forming apparatus includes a photosensitive drum, a primary transfer roller, a first voltage applicator, a first voltage controller, a current detector, a charging roller, a second voltage applicator, and a second voltage controller. A toner image is formed on the photosensitive drum. The primary transfer roller is disposed opposite to the photosensitive drum. The first voltage applicator applies a voltage to the primary transfer roller. The first voltage controller controls the voltage that is applied to the primary transfer roller through the first voltage applicator. The current detector detects a current value of a current flowing through the primary transfer roller. The charging roller charges the photosensitive drum. The second voltage applicator applies a voltage to the charging roller. The second voltage controller controls the voltage that is applied to the charging roller through the second voltage applicator. The second voltage controller causes a voltage having a smaller absolute value than a dark potential of the photosensitive drum to be applied to the photosensitive drum during a transfer voltage control period. The first voltage controller causes a voltage to be applied to the primary transfer roller during the transfer voltage control period. The current detector detects a current value of a current flowing through the primary transfer roller during the transfer voltage control period.

BRIEF DESCRIPTION OF THE DRAWINGS

FIG. 5A is a graph showing the voltage that is applied to the primary transfer for a yellow (Y) color. FIG. 5B is a graph showing the surface potential of the photosensitive drum for the Y color.

FIG. 6A is a graph showing the voltage that is applied to a primary transfer for the Y color. FIG. 6B is a graph showing the surface potential of the photosensitive drum for the Y color.

FIG. 7A is a graph showing the voltage that is applied to the primary transfer for the Y color. FIG. 7B is a graph showing the surface potential of the photosensitive drum for the Y color.

DETAILED DESCRIPTION

Figure 1:
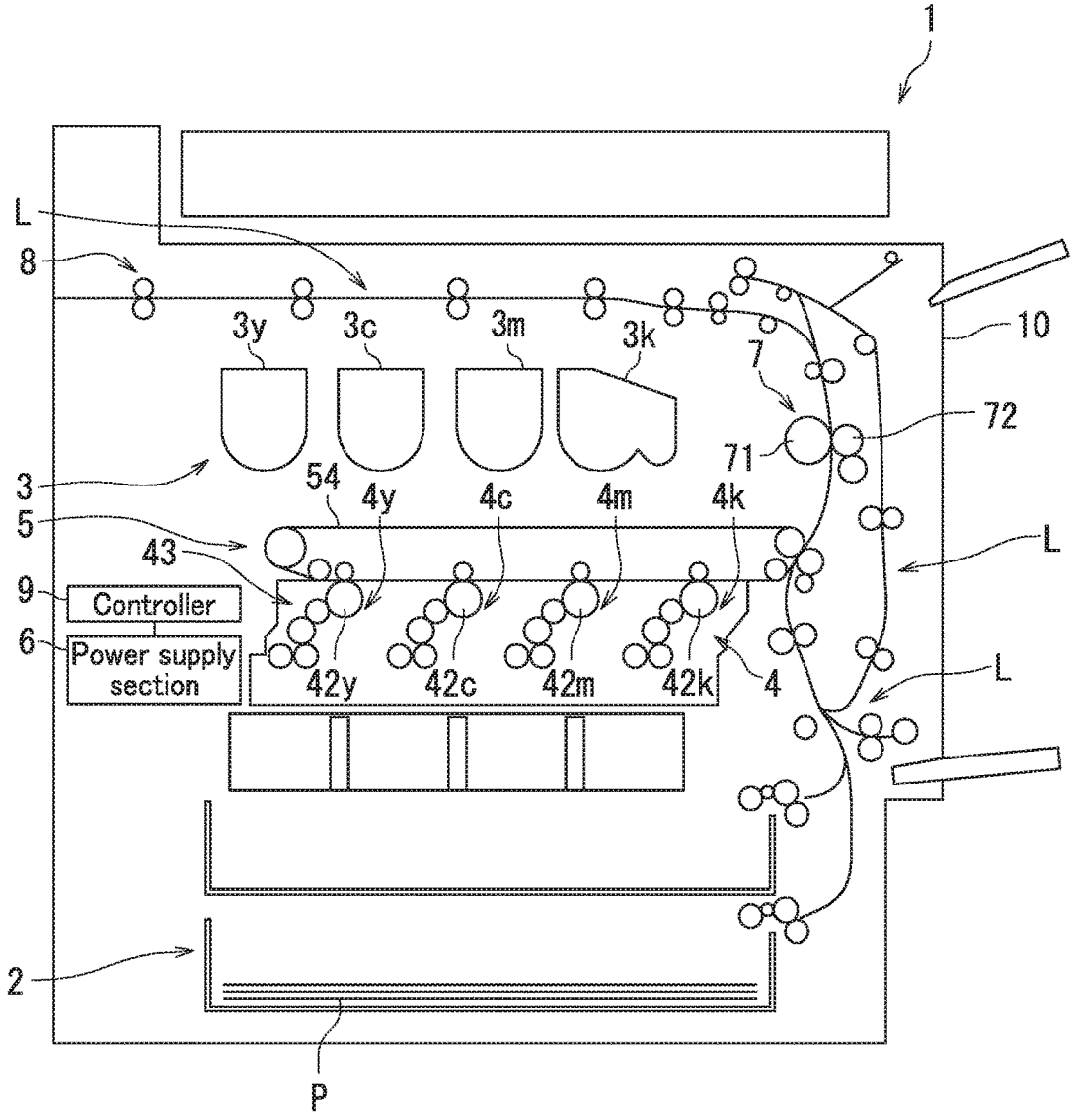
FIG. 1 is a diagram illustrating a configuration of an image forming apparatus according to an embodiment of the present disclosure.

The following describes an embodiment of the present disclosure with reference to the drawings (FIGS. 1 to 11). Elements that are the same or equivalent are indicated by the same reference signs in the drawing and description thereof is not repeated.

First, an image forming apparatus 1 according to the present embodiment will be described with reference to FIG. 1. The image forming apparatus 1 according to the present embodiment is a color copier. The image forming apparatus 1 forms an image on paper P. The image forming apparatus 1 includes a housing 10, a paper feed section 2, a conveyance section L, a toner replenishment unit 3, an image forming unit 4, a transfer section 5, a power supply section 6, a fixing section 7, an ejection section 8, and a controller 9.

The paper feed section 2 is disposed in a lower location of the housing 10 and feeds the paper P to the conveyance section L. The paper feed section 2 can accommodate a plurality of sheets of paper P. The paper feed section 2 feeds the paper P to the conveyance section L one upper most sheet of paper P at a time.

The conveyance section L conveys the paper P fed by the paper feed section 2 to the ejection section 8 through the transfer section 5 and the fixing section 7.

The toner replenishment unit 3 supplies toner to the image forming unit 4. The toner replenishment unit 3 includes four toner cartridges 3*y*, 3*c*, 3*m*, and 3*k*. The toner cartridge 3*y* contains a yellow toner. The toner cartridge 3*c* contains a cyan toner. The toner cartridge 3*m* contains a magenta toner. The toner cartridge 3*k* contains a black toner.

The image forming unit 4 includes four image forming sections 4*y*, 4*c*, 4*m*, and 4*k*. The yellow toner is supplied from the toner cartridge 3*y* to the image forming section 4*y*. The cyan toner is supplied from the toner cartridge 3*c* to the image forming section 4*c*. The magenta toner is supplied from the toner cartridge 3*m* to the image forming section 4*m*. The black toner is supplied from the toner cartridge 3*k* to the image forming section 4*k*.

The transfer section 5 includes an intermediate transfer belt 54. The image forming unit 4 forms toner images on the intermediate transfer belt 54, and the transfer section 5 transfers the toner images onto the paper P.

The power supply section 6 applies transfer voltages to the transfer section 5. The power supply section 6 also detects values of transfer currents flowing through the transfer section 5.

After the transfer section 5 has transferred the toner images onto the paper P, the fixing section 7 fixes the toner images to the paper P. More specifically, the fixing section 7 includes a heating roller 71 and a pressure roller 72. The heating roller 71 and the pressure roller 72 apply heat and pressure to the paper P. Through the above, the fixing section 7 fixes the unfixed toner images transferred onto the paper P by the transfer section 5. The ejection section 8 ejects the paper P having the toner images fixed thereon out of the apparatus. The controller 9 controls operation of the image forming apparatus 1.

Figure 2:
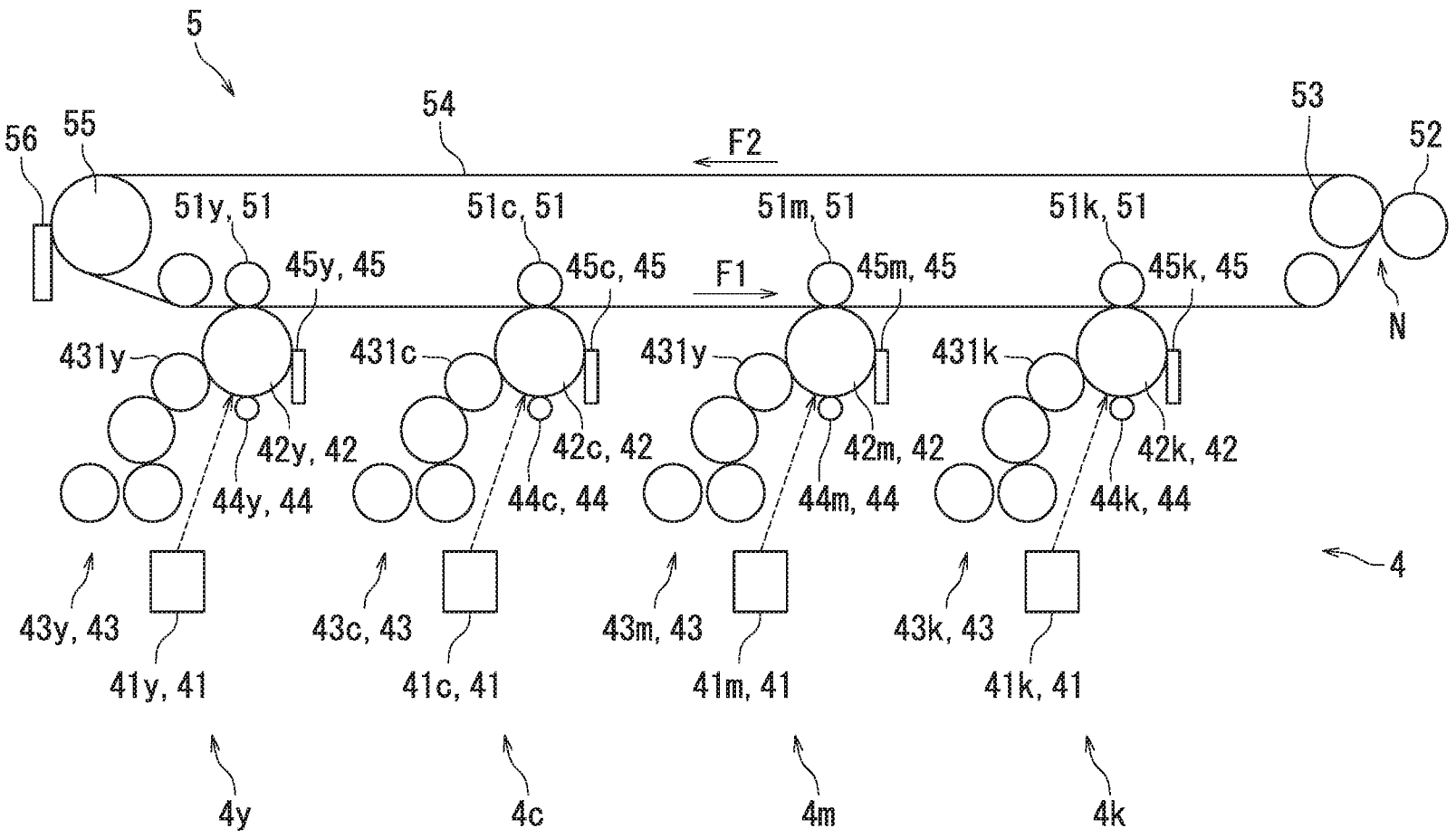
FIG. 2 is a diagram illustrating a configuration of an image forming unit and a transfer section.

Next, configurations of the image forming unit 4 and the transfer section 5 will be described with reference to FIG. 2. As illustrated in FIG. 2, the image forming unit 4 includes the four image forming sections 4*y*, 4*c*, 4*m*, and 4*k*.

The image forming sections 4*y*, 4*c*, 4*m*, and 4*k* each include a light exposure section 41, a photosensitive drum 42, a development section 43, a charging roller 44, and a cleaning blade 45. The four image forming sections 4*c*, 4*m*, 4*y*, and 4*k* have substantially the same configuration except the colors of the toners to be supplied thereto. The present specification therefore describes the configuration of the image forming section 4*y* to which the yellow toner is supplied, and omits description of the configuration of the image forming sections other than the image forming section 4*y*, that is, the image forming sections 4*c*, 4*m*, and 4*k*.

The image forming section 4*y* has a light exposure section 41*y* (41), a photosensitive drum 42*y* (42), a development section 43*y* (43), a charging roller 44*y* (44), and a cleaning blade 45*y* (45).

The charging roller 44*y* charges the photosensitive drum 42*y* to a specific potential. The light exposure section 41*y* irradiates the photosensitive drum 42*y* with laser light to form an electrostatic latent image on the photosensitive drum 42*y*. The development section 43*y* has a development roller 431*y*. The development roller 431*y* supplies the yellow toner to the photosensitive drum 42*y* and develops the electrostatic latent image to form a toner image. As a result, the toner image in yellow is formed on a circumferential surface of the photosensitive drum 42*y*.

An edge of the cleaning blade 45*y* is in sliding contact with the circumferential surface of the photosensitive drum 42*y* The edge of the cleaning blade 45*y* is a top edge of the cleaning blade 45*y* in FIG. 2. The edge of the cleaning blade 45*y* in sliding contact with the circumferential surface of the photosensitive drum 42*y* removes the yellow toner remaining on the circumferential surface of the photosensitive drum 42*y*.

The transfer section 5 transfers toner images onto the paper P. The transfer section 5 includes four primary transfer rollers 51*y*, 51*c*, 51*m*, and 51*k*, a secondary transfer roller 52, a drive roller 53, the intermediate transfer belt 54, a driven roller 55, and a blade 56.

The transfer section 5 transfers onto the intermediate transfer belt 54 toner images respectively formed on the photosensitive drums 42*y*, 42*c*, 42*m*, and 42*k* of the image forming sections 4*y*, 4*c*, 4*m*, and 4*k* such that the toner images are superimposed on one another. The transfer section 5 also transfers the superimposed toner images from the intermediate transfer belt 54 to the paper P.

The primary transfer roller 51*y* is disposed opposite to the photosensitive drum 42*y* with the intermediate transfer belt 54 therebetween. The primary transfer roller 51*y* comes in or out of pressed contact with the photosensitive drum 42*y* with the intermediate transfer belt 54 therebetween through driving by a drive mechanism, not illustrated. The primary transfer roller 51*y* is in pressed contact with the photosensitive drum 42*y* with the intermediate transfer belt 54 therebetween during printing or during a transfer voltage control period. As in the primary transfer roller 51*y*, the other primary transfer rollers 51*c*, 51*m*, and 51*k* are also in pressed contact with the photosensitive drums 42*c*, 42*m*, and 42*k*, respectively, with the intermediate transfer belt 54 therebetween during printing or during the transfer voltage control period.

The "transfer voltage control period" refers to a duration of time in which the controller 9 determines a resistance value R of each primary transfer roller 51 prior to printing. More specifically, during the "transfer voltage control period", a detection voltage VT that is varied to have different voltage values is applied to one of the primary transfer rollers 51, and a low voltage VL is applied to the other primary transfer rollers 51. The one primary transfer roller 51 for example corresponds to the primary transfer roller 51*y*. The other primary transfer rollers 51 for example correspond to the primary transfer rollers 51*c*, 51*m*, and 51*k*. Furthermore, current values of currents flowing through the primary transfer rollers 51 are detected. Then, the resistance value R of the one primary transfer roller 51 is determined.

The drive roller 53 is disposed opposite to the secondary transfer roller 52 and drives the intermediate transfer belt 54.

The intermediate transfer belt 54 is an endless belt that is stretched around the driven roller 55 and the four primary transfer rollers 51*y*, 51*c*, 51*m*, and 51*k*. The intermediate transfer belt 54 is driven by the drive roller 53 to rotate in a counterclockwise direction as indicated by arrows F1 and F2 in FIG. 2. An outer surface of the intermediate transfer belt 54 is in contact with circumferential surfaces of the respective photosensitive drums 42*y*, 42*c*, 42*m*, and 42*k*. Toner images are transferred by the primary transfer rollers 51 (51*y*, 51*c*, 51*m*, and 51*k*) from the photosensitive drums 42 (42*y*, 42*c*, 42*m*, and 42*k*) to the outer surface of the intermediate transfer belt 54.

The driven roller 55 is driven to rotate by circulation of the intermediate transfer belt 54. The blade 56 is disposed opposite to a position in the driven roller 55 with the intermediate transfer belt 54 therebetween. The blade 56 removes toner remaining on the outer surface of the intermediate transfer belt 54.

The secondary transfer roller 52 is pressed against the drive roller 53. As a result, the secondary transfer roller 52 and the drive roller 53 form a nip N therebetween. The secondary transfer roller 52 and the drive roller 53 transfer toner images from the intermediate transfer belt 54 to the paper P while the paper P is passing through the nip N.

Figure 3:
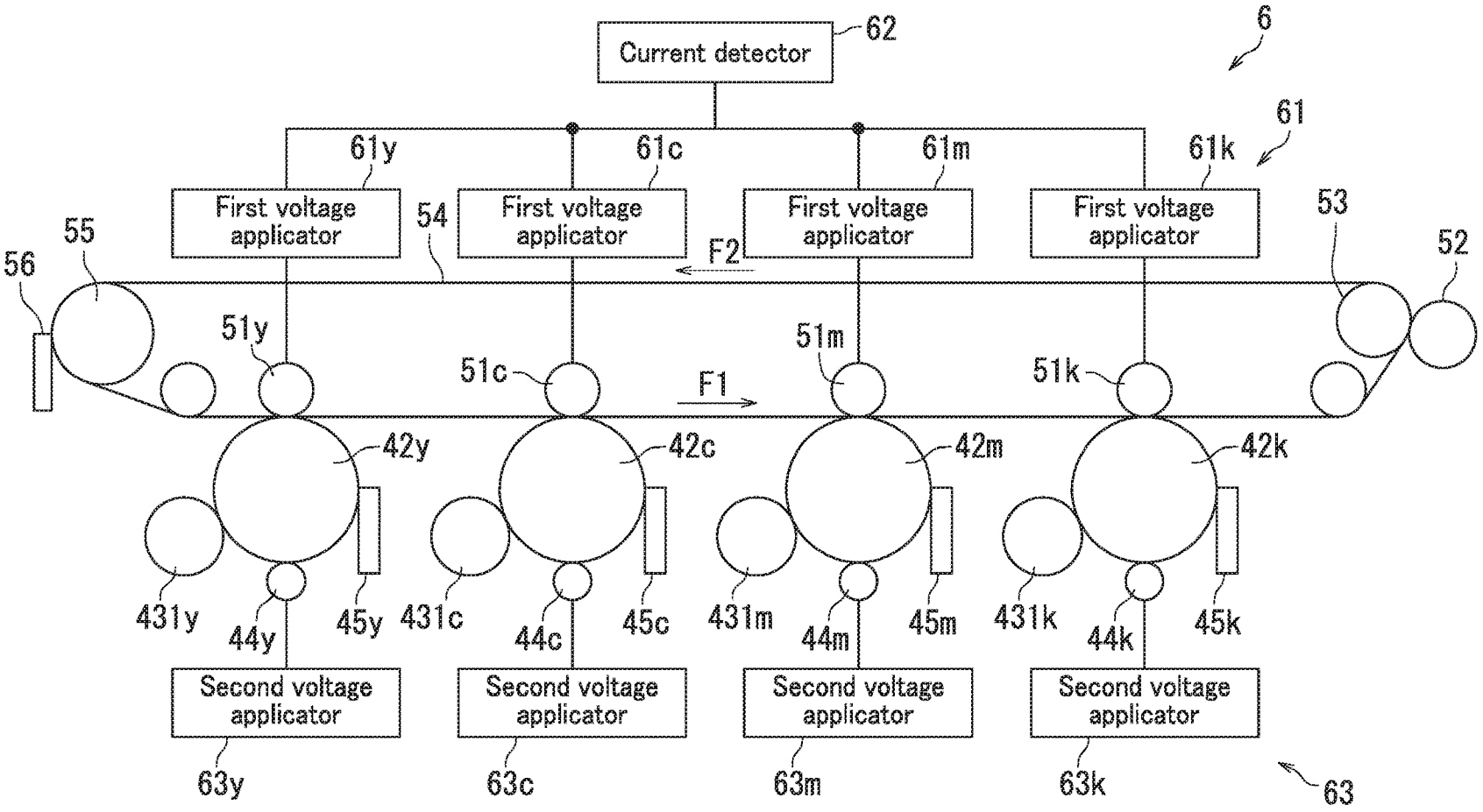
FIG. 3 is a diagram illustrating an example of a configuration of a power supply section.

Next, the power supply section 6 will be described with reference to FIG. 3. The power supply section 6 includes first voltage applicators 61, a current detector 62, and second voltage applicators 63.

The first voltage applicators 61 include four first voltage applicators 61*y*, 61*c*, 61*m*, and 61*k*. The four first voltage applicators 61*y*, 61*c*, 61*m*, and 61*k* respectively apply voltages to the primary transfer rollers 51*y*, 51*c*, 51*m*, and 51*k*. For example, the first voltage applicator 61*y* applies a voltage to the primary transfer roller 51*y*. The photosensitive drums 42 (42*y*, 42*c*, 42*m*, and 42*k*) are grounded. More specifically, central shafts, not illustrated, of the photosensitive drums 42 are grounded. As a result, the first voltage applicators 61 apply voltages between the primary transfer rollers 51 and the photosensitive drums 42.

The current detector 62 detects a total current value JS, which is a sum of values of currents flowing through the respective four primary transfer rollers 51*y*, 51*c*, 51*m*, and 51*k*.

The second voltage applicators 63 include four second voltage applicators 63*y*, 63*c*, 63*m*, and 63*k*. The four second voltage applicators 63*y*, 63*c*, 63*m*, and 63*k* respectively apply voltages to the charging rollers 44*y*, 44*c*, 44*m*, and 44*k*. For example, the second voltage applicator 63*y* applies a voltage to the charging roller 44*y*.

Figure 4:
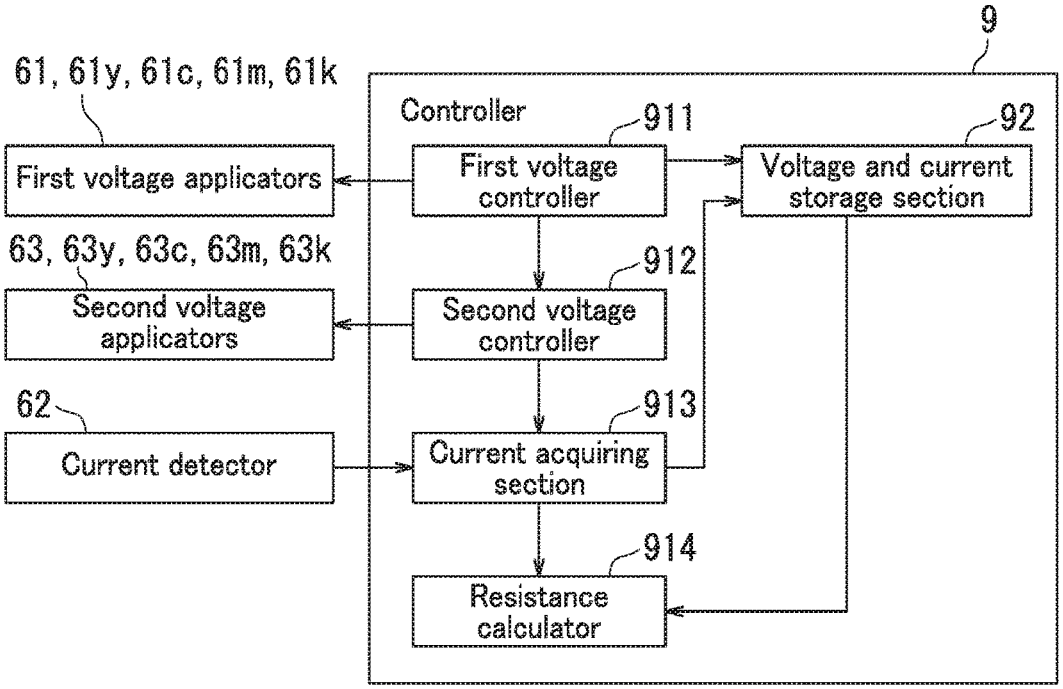
FIG. 4 is a diagram illustrating a configuration of a controller.

Next, a configuration of the controller 9 will be described with reference to FIG. 4. The controller 9 includes a central processing unit (CPU) and memory. A control program is stored in the memory. The CPU implements various functional sections through execution of the control program. As a result, the various functional sections implemented by the controller 9 control operation of the image forming apparatus 1. The controller 9 includes a first voltage controller 911, a second voltage controller 912, a current acquiring section 913, a resistance calculator 914, and a voltage and current storage section 92.

The voltage and current storage section 92 stores therein the voltage values of the detection voltage VT applied by the first voltage applicators 61 to the respective primary transfer rollers 51 in association with the total current values JS detected by the current detector 62. The voltage values of the detection voltage VT and the total current values JS are read by the resistance calculator 914 from the voltage and current storage section 92.

The first voltage controller 911 controls the voltages that are applied to the primary transfer rollers 51*y*, 51*c*, 51*m*, and 51*k* through the first voltage applicators 61. More specifically, during the transfer voltage control period, the first voltage controller 911 causes the detection voltage VT to be applied to one primary transfer roller 51 of the four primary transfer rollers 51 and the low voltage VL having the same polarity as the detection voltage VT to be applied to the other primary transfer rollers 51. The one primary transfer roller 51 is for example the primary transfer roller 51*y*, and the other primary transfer rollers 51 are for example the primary transfer rollers 51*c*, 51*m*, and 51*k*. The detection voltage VT is a voltage that is applied for detection of the resistance value R between the one, primary transfer roller 51 and the corresponding photosensitive drum 42. The voltage value of the low voltage VL is from one-200th to one-tenth of the voltage value of the detection voltage VT.

The first voltage controller 911 causes the detection voltage VT that is varied to have different voltage values to be applied to the one primary transfer roller 51. The voltage values of the detection voltage VT according to the present embodiment include four voltage values VS, V11, V12, and V13.

The second voltage controller 912 controls voltages that are applied to the charging rollers 44 through the second voltage applicators 63. The second voltage controller 912 also controls surface potentials V2 of the photosensitive drums 42 through control of the voltages to be applied to the charging rollers 44. More specifically, in a configuration in which the photosensitive drums 42 include an organic photoconductor as a photosensitive member, the second voltage controller 912 causes a voltage that is substantially equal to a light potential V21 of the photosensitive drums 42 to be applied to the photosensitive drums 42 during the transfer voltage control period. In a configuration in which the photosensitive drums 42 include an amorphous silicon photoconductor as a photosensitive member, the second voltage controller 912 causes no voltage to be applied to the photosensitive drums 42 during the transfer voltage control period.

The term "light potential V21" refers to the surface potential V2 of each photosensitive drum 42 when the corresponding light exposure section 41 performs light exposure for printing at 100% coverage after the corresponding charging roller 44 has charged the photosensitive drum 42 during printing. The term "dark potential V22" refers to the surface potential V2 of each photosensitive drum 42 when the corresponding light exposure section 41 does not perform light exposure after the corresponding charging roller 44 has charged the photosensitive drum 42 during printing. The "dark potential. V22" is substantially equal to the voltage that is caused to be applied to the charging rollers 44 by the second voltage controller 912 during printing.

The current acquiring section 913 acquires the total current values JS detected by the current detector 62. The current acquiring section 913 also stores, in the voltage and current storage section 92, the total current values JS in association with the voltage values of the detection voltage VT applied by each of the first voltage applicator 61 to a corresponding one of the primary transfer rollers 51*y*, 51*c*, 51*m*, and 51*k*.

The resistance calculator 914 determines the resistance value R between each of the primary transfer rollers 51 and a corresponding one of the photosensitive drums 42. For example, the first voltage controller 911 causes the detection voltage VT to be applied to the primary transfer roller 51*y* and the low voltage VL to be applied to the other primary transfer rollers 51*c*, 51*m*, and 51*k*. During the voltage application, the current acquiring section 913 acquires total current values JSy. Based on the voltage values of the detection voltage VT and the total current values JSy, the resistance calculator 914 determines a value of resistance Ry between the primary transfer roller 51*y* and the photosensitive drum 42*y*.

In the description given below, values of resistance Ry, Rc, Rm, and Rk may be respectively referred to as the resistance value Ry of the primary roller 51*y*, the resistance value Rc of the primary transfer roller 51*c*, the resistance value Rm of the primary transfer roller 51*m*, and the resistance value Rk of the primary transfer roller 51*k* for convenience. The paper P corresponds to an example of what is referred to as "a recording medium". What is referred to as "a specified number" is four in the present embodiment. Furthermore, the toners that are supplied to the photosensitive drums 42 are positively charged in the present embodiment.

Figure 5A:
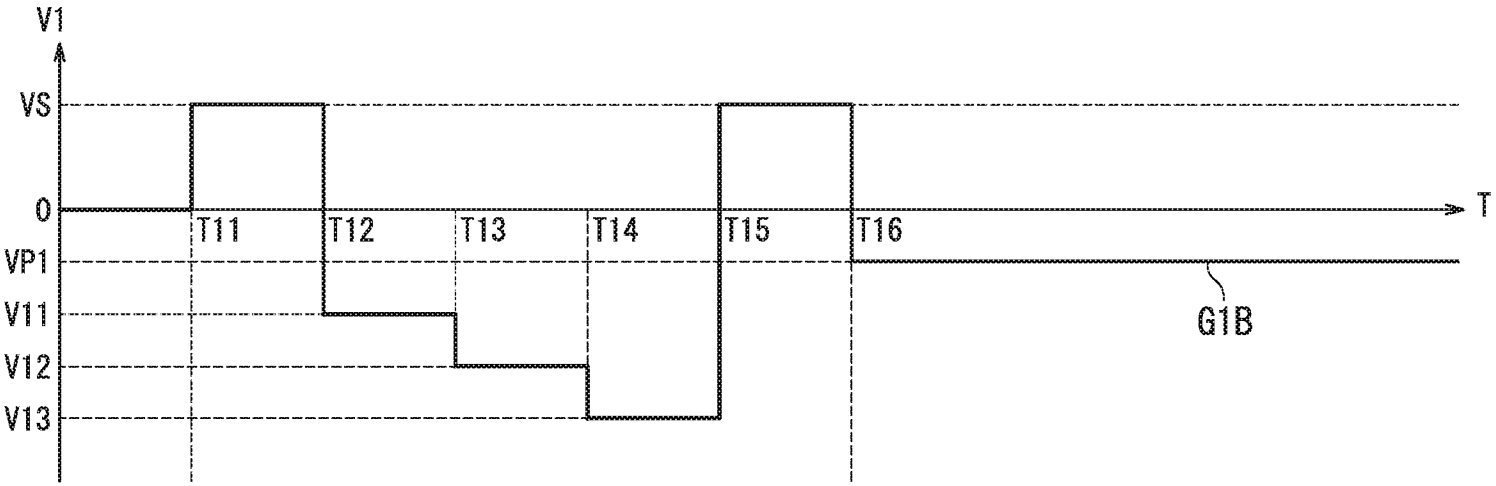
FIGS. 5A and 5B are graphs showing an example of a voltage that is applied to a primary transfer roller and a surface potential of a photosensitive drum in a configuration in which the photosensitive drum includes an organic photoconductor as a photosensitive member.
Figure 5B:
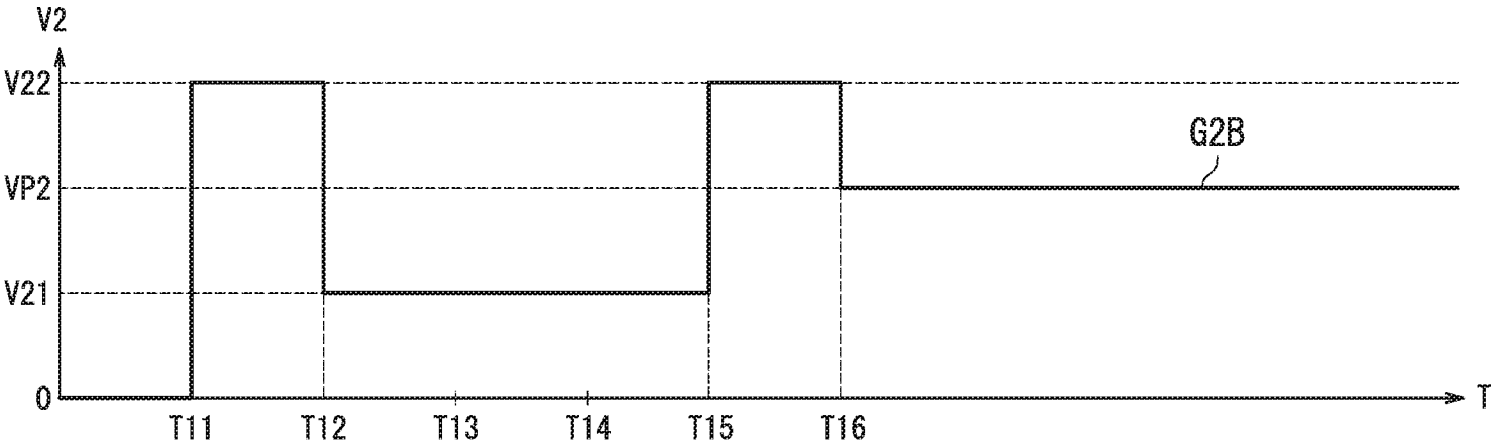

The following describes an example of the voltages to be applied to the primary transfer rollers 51 and the surface potentials of the photosensitive drums 42 with reference to FIGS. 5A and 5B. The photosensitive drums 42 include an organic photoconductor (OPC) as a photosensitive member. FIG. 5A is a graph G1B showing a voltage V1 applied to the primary transfer roller 51*y* for a yellow (Y) color. FIG. 5B is a graph G2B showing a surface potential V2 of the photosensitive drum 42*y* for the Y (yellow) color. The horizontal axis in the graphs G1B and G2B represents time T. The vertical axis in the graph G1B represents the voltage V1. The vertical axis in the graph G2B represents the surface potential V2.

During the transfer voltage control period, the first voltage controller 911 causes the detection voltage VT to be applied to the primary transfer roller 51*y* from among the four primary transfer rollers 51*y*, 51*c*, 51*m*, and 51*k*. The first voltage controller 911 also causes the low voltage VL, which has the same polarity as the detection voltage VT, to be applied to the primary transfer rollers 51*c*, 51*m*, and 51*k* (not illustrated).

First, variation of the voltage V1 will be described with reference to FIG. 5A. At time point T11, the first voltage controller 911 causes the detection voltage VT having the voltage value VS to be applied to the primary transfer roller 51*y*. At time point T12, the first voltage controller 911 changes the voltage V1 that is applied to the primary transfer roller 51*y* from the voltage value VS to the voltage value V11. Next, at time point T13, the first voltage controller 911 changes the voltage V1 from the voltage value V11 to the voltage value V12. Furthermore, at time point T14, the first voltage controller 911 changes the voltage V1 from the voltage value V12 to the voltage value V13. Next, at time point T15, the first voltage controller 911 changes the voltage V1 from the voltage value V13 to the voltage value VS. Then, at time point T16, the first voltage controller 911 changes the voltage V1 from the voltage value VS to a decisive voltage VP1.

A duration from time point T11 to time point T15 corresponds to the transfer voltage control period. A duration from time point T15 to time point T16 corresponds to a sheet interval passage period. The "sheet interval" refers to an interval between two successive sheets of paper P. A duration after time point T16 corresponds to a duration of printing. An absolute value of the low voltage VL is for example −100 V. The voltage value VS is for example +500 V. The voltage value V11 is for example −700 V. The voltage value V12 is for example −1,000 V. The voltage value V13 is for example −1,300 V. The decisive voltage VP1 is for example −500 V. The decisive voltage VP1 is a voltage that the first voltage applicator 61*y* applies to the primary transfer roller 51*y* during printing. The first voltage controller 911 determines the decisive voltage VP1 based on the resistance value Ry.

As described with reference to FIG. 5A, the first voltage controller 911 causes the detection voltage VT having the voltage value VS to be applied to the primary transfer roller 51*y* during a duration from time point T11 to time point T12. The first voltage controller 911 also causes the low voltage VL having a polarity corresponding to the voltage value VS to be applied to the other three primacy transfer rollers 51*c*, 51*m*, and 51*k*. In this duration, the current acquiring section 913 acquires the total current value JSy corresponding to the voltage value VS.

In a duration from time point T12 to time point T13, the first voltage controller 911 causes the detection voltage VT having the voltage value V11 to be applied to the primary transfer roller 51*y*. The first voltage controller 911 also causes the low voltage VL having a polarity corresponding to the voltage value VS to be applied to the other three primary transfer rollers 51*c*, 51*m*, and 51*k*. In this duration, the current acquiring section 913 acquires the total current value JSy corresponding to the voltage value V11.

In a duration from time point T13 to time point T14, the first voltage controller 911 causes the detection voltage VT having the voltage value V12 to be applied to the primary transfer roller 51*y*. The first voltage controller 911 also causes the low voltage VL having a polarity corresponding to the voltage value V12 to be applied to the other three primary transfer rollers 51*c*, 51*m*, and 51*k*. In this duration, the current acquiring section 913 acquires the total current value JSy corresponding to the voltage value V12.

In a duration from time point T14 to time point T15, the first voltage controller 911 causes the detection voltage VT having the voltage value V13 to be applied to the primary transfer roller 51*y*. The first voltage controller 911 also causes the low voltage VL having a polarity corresponding to the voltage value V13 to be applied to the other three primary transfer rollers 51*c*, 51*m*, and 51*k*. In this duration, the current acquiring section 913 acquires the total current value JSy corresponding to the voltage value V13.

Thus, in the duration from time point T11 to time point T15, the four total current values JSy respectively corresponding to the voltage values VS, V11, V12, and V13 of the detection voltage VT are acquired. The resistance calculator 914 determines the resistance value Ry of the primary transfer miler 51*y* based on the voltage values VS, V11, V12, and V13 and the four total current values JSy.

The following describes variation of the surface potential V2 of the photosensitive drum 42*y* with reference to FIG. 5B. At time point T11, the second voltage controller 912 causes the dark potential V22 to be applied to the charging roller 44*y* so that the surface potential V2 of the photosensitive drum 42*y* becomes the dark potential V22. Subsequently, at time point T12, the second voltage controller 912 causes the photosensitive drum 42*y* to be exposed to light for printing at 100% coverage so that the surface potential V2 of the photosensitive drum 42*y* becomes the light potential V21. Next, at time point T15, the second voltage controller 912 causes the dark potential V22 to be applied to the charging roller 44*y* so that the surface potential V2 of the photosensitive drum 42*y* becomes the dark potential V22. Subsequently, at time point T16, the second voltage controller 912 causes the light exposure section 41*y* to expose the photosensitive drum 42*y* to light to form an electrostatic latent image based on image data. As a result, the surface potential V2 of the photosensitive drum 42*y* becomes a printing potential VP2.

The photosensitive drums 42 in FIGS. 5A and 5B include an organic photoconductor as a photosensitive member. In a configuration in which the photosensitive drums 42 include an organic photoconductor as a photosensitive member, the dark potential V22 is for example +450 V. The light potential V21 is for example +100 V. The printing potential VP2 is for example +200 V. An absolute value of the printing potential VP2 decreases with increase in the coverage of the image data used for printing. In the case of 100% coverage, for example, the printing potential VP2 is equal to the light potential V21. In the case of 0% coverage, for example, the printing potential VP2 is equal to the dark potential V22.

Figure 6A:
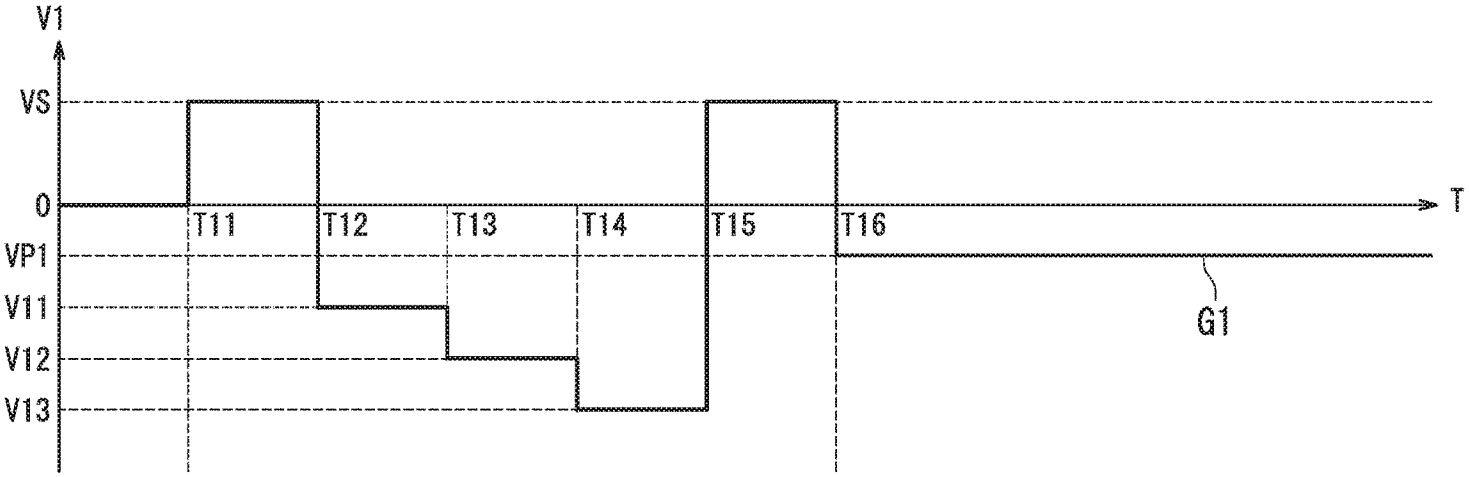
FIGS. 6A and 6B are graphs showing another example of a voltage that is applied to a primary transfer roller and a surface potential of a photosensitive drum in a configuration in which the photosensitive drum includes an organic photoconductor as a photosensitive member.
Figure 6B:
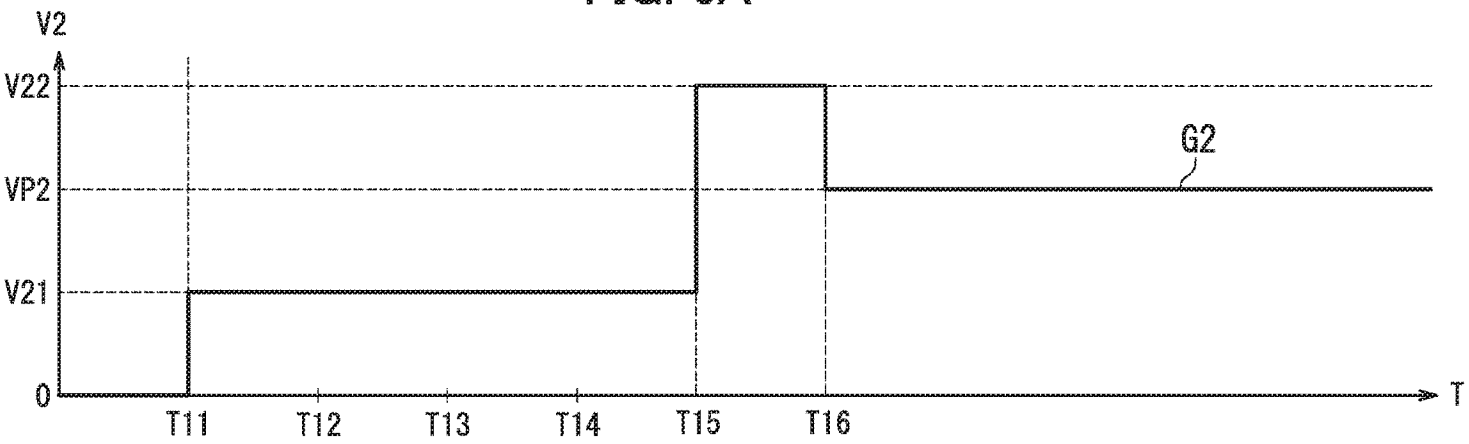

The following describes another example of the voltages to be applied to the primary transfer rollers 51 and the surface potentials of the photosensitive drums 42 with reference to FIGS. 6A and 6B. The photosensitive drums 42 include an organic photoconductor as a photosensitive member. FIG. 6A is a graph G1 showing the voltage V1 applied to the primary transfer roller 51*y* for the yellow (Y) color.

FIG. 6B is a graph G2 showing the surface potential V2 of the photosensitive drum 42*y* for the Y (yellow) color. The horizontal axis in the graphs G1 and G2 represents time T. The vertical axis in the graph G1 represents the voltage V1. The vertical axis in the graph G2 represents the surface potential V2.

During the transfer voltage control period, the first voltage controller 911 causes the detection voltage VT to be applied to the primary transfer roller 51*y* from among the four primary transfer rollers 51. The first voltage controller 911 also causes the low voltage VL, which has the same polarity as the detection voltage VT, to be applied to the primary transfer rollers 51*c*, 51*m*, and 51*k* (not illustrated).

The graph G1 shown in FIG. 6A is the same as the graph G1B shown FIG. 5A, and therefore description thereof is omitted.

The following describes variation of the surface potential V2 of the photosensitive drum 42*y* with reference to FIG. 6B. At time point T11, the second voltage controller 912 causes the second voltage applicator 63*y* to apply the light potential V21 to the charging roller 44*y* so that the surface potential V2 of the photosensitive drum 42*y* becomes the light potential V21. Next, at time point T15, the second voltage controller 912 causes the second voltage applicator 63*y* to apply the dark potential V22 to the charging roller 44*y* so that the surface potential V2 of the photosensitive drum 42*y* becomes the dark potential V22. Subsequently, at time point T16, the second voltage controller 912 causes the light exposure section 41*y* to expose the photosensitive drum 42*y* to light to form an electrostatic latent image based on image data. As a result, the surface potential V2 of the photosensitive drum 42*y* becomes the printing potential VP2.

As described with reference to FIG. 6B, at time point T11, the photosensitive drum 42*y* is charged to the light potential V21 having a smaller absolute value than the dark potential V22. Thus, the time required to charge the photosensitive drum 42*y* can be reduced. In a duration from time point T11 to time point T12, the light potential V21 having a smaller absolute value than the dark potential V22 is applied to the photosensitive drum 42*y*. Thus, error of measurement of the resistance value Ry of the primary transfer roller 51*y* can be reduced.

Figure 7A:
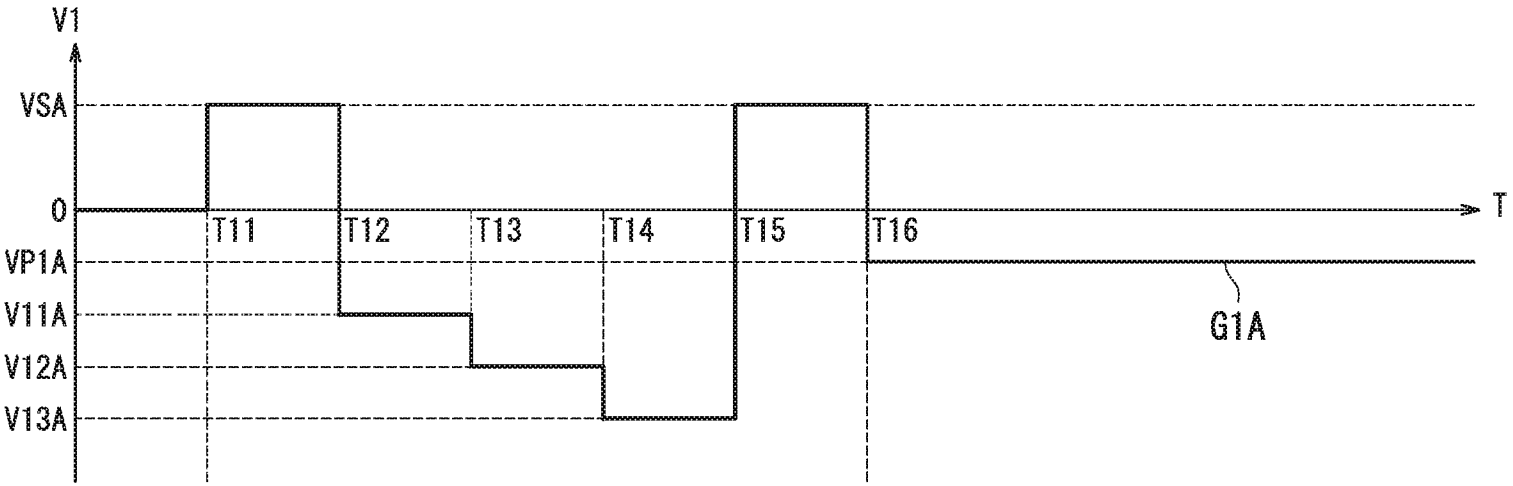
FIGS. 7A and 7B are graphs showing an example of a voltage that is applied to a primary transfer roller and a surface potential of a photosensitive drum in a configuration in which the photosensitive drum includes an amorphous silicon photoconductor as a photosensitive member.
Figure 7B:
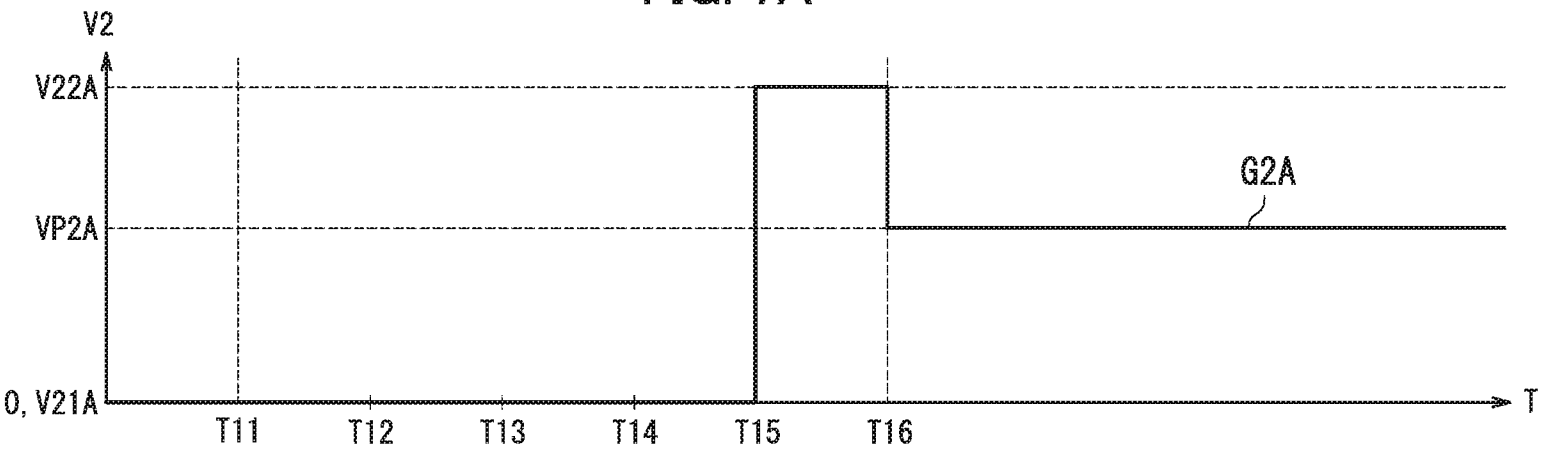

The following describes another example of the voltages to be applied to the primary transfer rollers 51 and the surface potentials of the photosensitive drums 42 with reference to FIGS. 7A and 7B. The photosensitive drums 42 include an amorphous silicon photoconductor as a photosensitive member. FIG. 7A is a graph G1A showing the voltage V1 applied to the primary transfer roller 51*y* for the yellow (Y) color. FIG. 7B is a graph G2A showing the surface potential V2 of the photosensitive drum 42*y* for the Y (yellow) color. The horizontal axis in the graphs represents time T. The vertical axis in the graph G1A represents the voltage V1. The vertical axis in the graph G2A represents the surface potential V2.

During the transfer voltage control period, the first voltage controller 911 causes the detection voltage VT to be applied to the primary transfer roller 51*y* from among the four primary transfer rollers 51. The first voltage controller 911 also causes a low voltage VLA, which has the same polarity as the detection voltage VT, to be applied to the primary transfer rollers 51*c*, 51*m*, and 51*k* (not illustrated).

The graph G1A shown in FIG. 7A is different from the graph G1 shown in FIG. 5A in the following point. That is, in FIG. 5A, the first voltage controller 911 causes the detection voltage VT that is varied to have the voltage values VS, V11, V12, and V13 to be applied to the primary transfer roller 51*y*. In contrast, in FIG. 7A, the first voltage controller 911 causes the detection voltage VT that is varied to have voltage values VSA, V11A, V12A, and V13A to be applied to the primary transfer roller 51*y*. The voltage values VSA, V11A, V12A, and V13A may be respectively equal to or different from the voltage values VS, V11, V12, and V13. In other words, the voltage values VSA, V11A, V12A, and V13A are not particularly limited other than being different values from one another.

The following describes variation of the surface potential V2 of the photosensitive drum 42*y* with reference to FIG. 7B. At time point T11, the second voltage controller 912 causes no voltage to be applied to the charging roller 44*y* so that the surface potential V2 of the photosensitive drum 42*y* is 0 V. Next, at time point T15, the second voltage controller 912 causes the second voltage applicator 63*y* to apply a dark potential V22A to the charging roller 44*y* so that the surface potential V2 of the photosensitive drum 42*y* becomes a dark potential V22A. Subsequently, at time point T16, the second voltage controller 912 causes the light exposure section 41*y* to expose the photosensitive drum 42*y* to light to form an electrostatic latent image based on image data. As a result, the surface potential V2 of the photosensitive drum 42*y* becomes a printing potential VP2A.

The photosensitive drums 42 in FIGS. 7A and 7B include an amorphous silicon photoconductor as a photosensitive member. In a configuration in which the photosensitive drums 42 include an amorphous silicon photoconductor as a photosensitive member, the dark potential V22A is for example +230 V and the light potential V21A is for example 0 V. The printing potential VP2A is for example +100 V. An absolute value of the printing potential VP2A decreases with increase in the coverage of the image data used for printing. In the case of 100% coverage, for example, the printing potential VP2A is equal to the light potential V21A. In the case of 0% coverage, for example, the printing potential VP2A is equal to the dark potential V22A.

As described with reference to FIGS. 7A and 7B, in a duration from time point T11 to time point T12, the surface potential V2 of the photosensitive drum 42*y* is 0 V, which has a smaller absolute value than the dark potential V22A. In other words, the photosensitive drum 42*y* is not charged. Thus, the time required to charge the photosensitive drum 42*y* can be significantly reduced. Furthermore, error of measurement of the resistance value Ry of the primary transfer roller 51*y* can be reduced through the surface potential V2 of the photosensitive drum 42*y* being 0 V, which has a smaller absolute value than the dark potential V22A, in the duration from time point T11 to time point T12.

Figure 8:
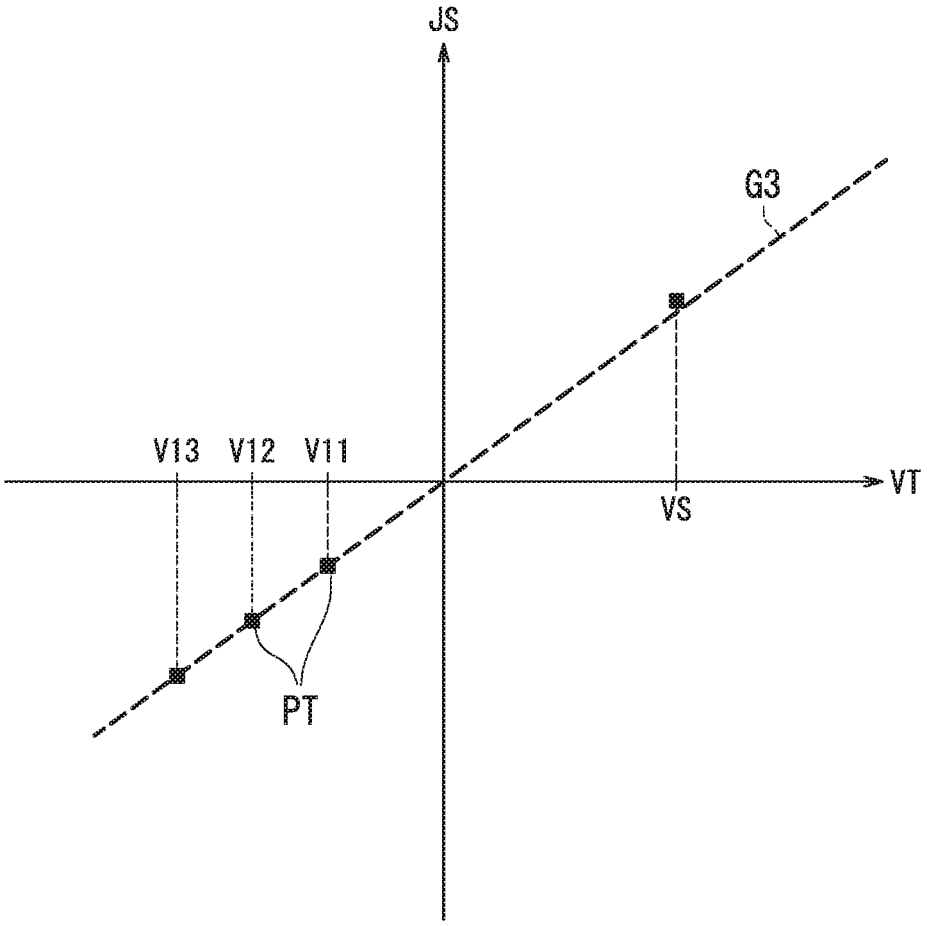
FIG. 8 is a graph showing a relationship between voltage values of a detection voltage applied by a first voltage applicator and total current values detected by a current detector.

The following describes operation of the resistance calculator 914 with reference to FIG. 8. FIG. 8 is a graph G3 showing a relationship between the voltage values of the detection voltage VT applied by one of the first voltage applicators 61 and the total current values JS detected by the current detector 62. In the graph G3, the horizontal axis represents the voltage values of the detection voltage VT, and the vertical axis represents the total current values JS. Square marks indicate measurement points PT. The resistance calculator 914 determines the resistance value R (Ry, Rc, Rm, or Rk) based on the slope of the straight line in the graph G3.

More specifically, the first voltage controller 911 controls the detection voltage VT that is applied to the primary transfer roller 51*y* to the voltage values VS, V11, V12, and V13 as described with reference to FIGS. 6A and 6B. The current acquiring section 913 acquires the total current values JS respectively corresponding to the voltage values VS, V11, V12, and V13 from the current detector 62. The resistance calculator 914 then determines a straight line in the graph G3 from coordinates of the four measurement points in accordance with the least square method, for example. The resistance calculator 914 determines the resistance value Ry of the primary transfer roller 51*y* by determining the inverse of the slope of the straight line in the graph G3.

The first voltage controller 911 controls the detection voltage VT that is applied to the primary transfer roller 51*c* to the voltage values VS, V11, V12, and V13 in the same manner as described above. The current acquiring section 913 acquires the total current values JS respectively corresponding to the voltage values VS, V11, V12, and V13 from the current detector 62. The resistance calculator 914 then determines a straight line from coordinates of the four measurement points in accordance with the least square method, for example. The resistance calculator 914 determines the resistance value Rc of the primary transfer roller 51*c* by determining the inverse of the slope of the straight line.

Likewise, the first voltage controller 911 controls the detection voltage VT that is applied to the primary transfer roller 51*m* to the voltage values VS, V11, V12, and V13. The current acquiring section 913 acquires the total current values JS respectively corresponding to the voltage values VS, V11, V12, and V13 from the current detector 62. The resistance calculator 914 then determines a straight line from coordinates of the four measurement points in accordance with the least square method, for example. The resistance calculator 914 determines the resistance value Rm of the primary transfer roller 51*m* by determining the inverse of the slope of the straight line.

Furthermore, the first voltage controller 911 controls the detection voltage VT that is applied to the primary transfer roller 51*k* to the voltage values VS, V11, V12, and V13. The current acquiring section 913 acquires the total current values JS respectively corresponding to the voltage values VS, V11, V12, and V13 from the current detector 62. The resistance calculator 914 then determines a straight line from coordinates of the four measurement points in accordance with the least square method, for example. The resistance calculator 914 determines the resistance value Rk of the primary transfer roller 51*k* by determining the inverse of the slope of the straight line.

Figure 9:
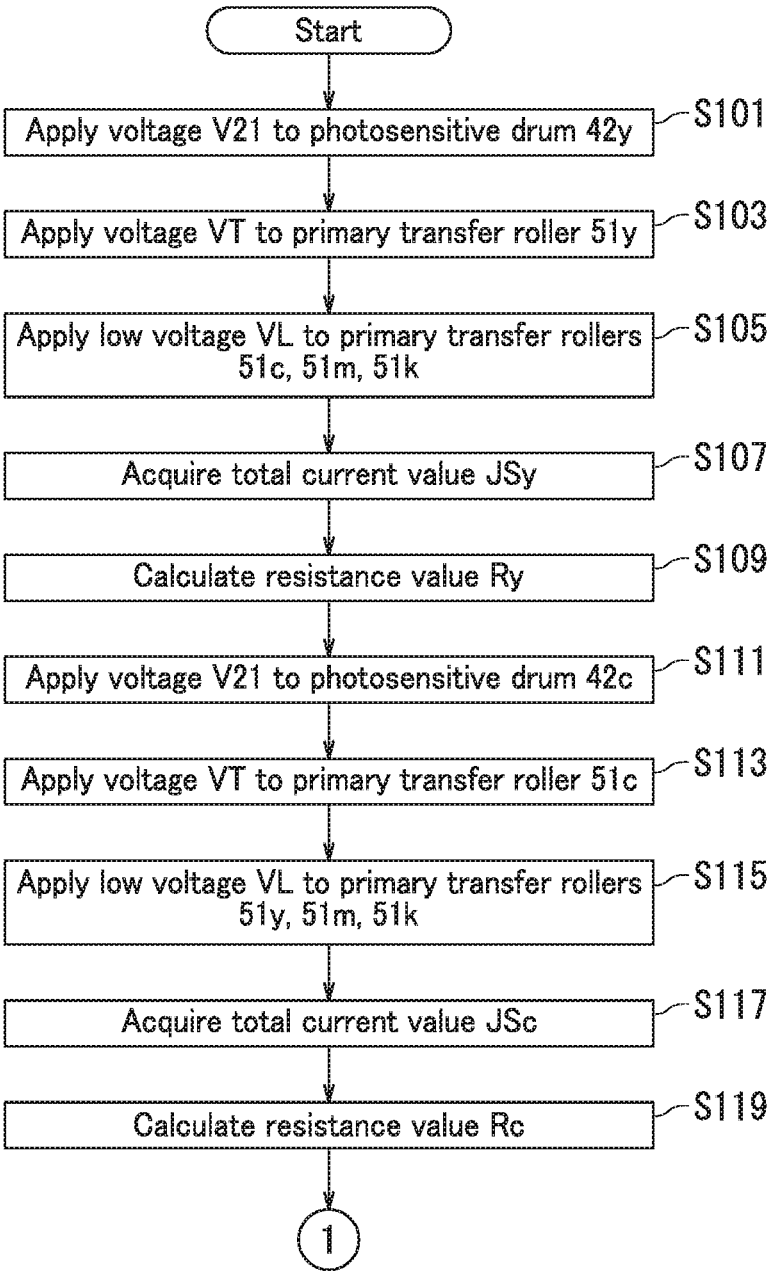
FIG. 9 is a flowchart illustrating operation of a controller for determining resistance values of primary transfer rollers.
Figure 10:
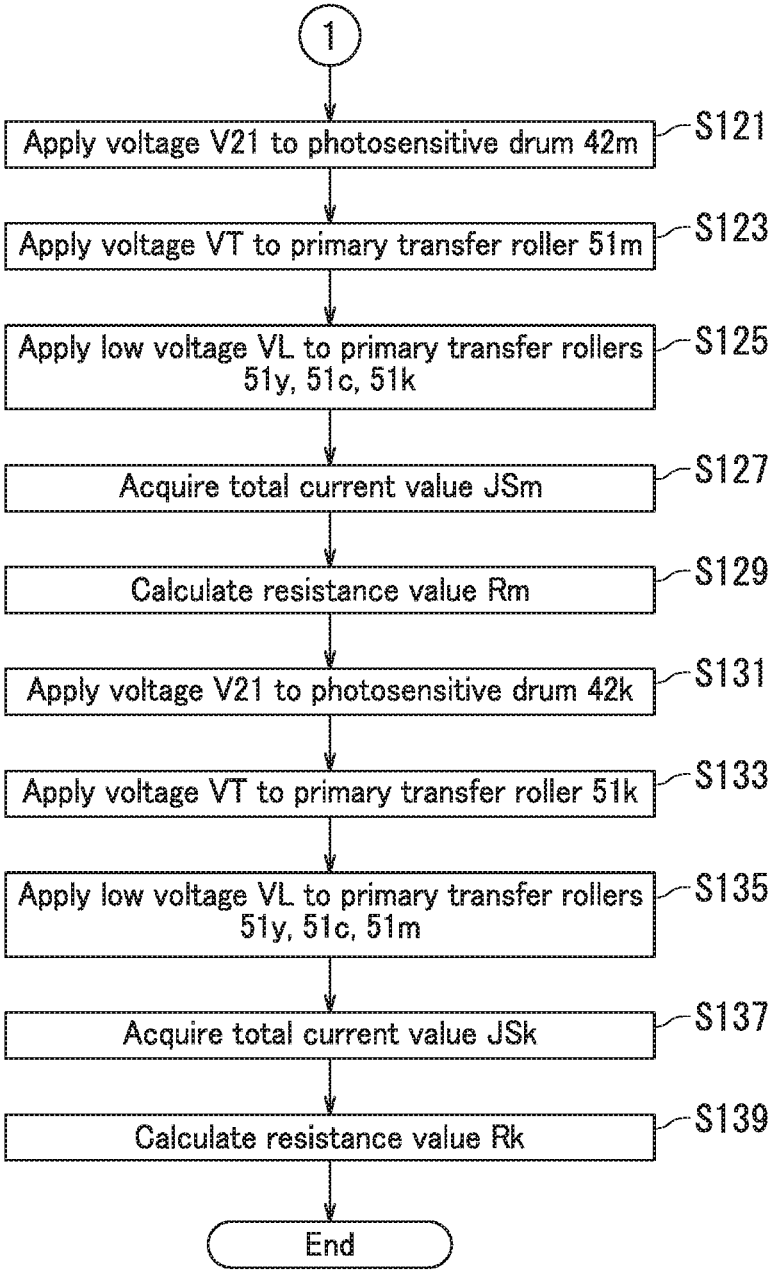
FIG. 10 is a flowchart illustrating the operation of the controller for determining the resistance values of the primary transfer rollers.

The following describes operation of the controller 9 for determining the resistance value R of each primary transfer roller 51 with reference to FIGS. 9 and 10. First, in step S101 in FIG. 9, the second voltage controller 912 causes the light potential V21 to be applied to the photosensitive drum 42*y*. Next, in step S103, the first voltage controller 911 causes the detection voltage VT to be applied to the primary transfer roller 51*y*. In step S105, the first voltage controller 911 causes the low voltage VL to be applied to the other three primary transfer rollers 51*c*, 51*m*, and 51*k*. Next, in step S107, the current acquiring section 913 acquires the total current value JSy detected by the current detector 62. Next, in step S109, the resistance calculator 914 determines the resistance value Ry of the primary transfer roller 51*y* based on the detection voltage VT and the total current value JSy.

Next, in step S111, the second voltage controller 912 causes the light potential V21 to be applied to the photosensitive drum 42*c*. Then, in step S113, the first voltage controller 911 causes the detection voltage VT to be applied to the primary transfer roller 51*c*. In step S115, the first voltage controller 911 causes the low voltage VL to be applied to the other three primary transfer rollers 51*y*, 51*m*, and 51*k*. Next, in step S117, the current acquiring section 913 acquires the total current value JSc from the current detector 62. Next, in step S119, the resistance calculator 914 determines the resistance value Rc of the primary transfer roller 51*c* based on the detection voltage VT and the total current value JSc.

Next, in step S121 in FIG. 10, the second voltage controller 912 causes the light potential V21 to be applied to the photosensitive drum 42*m*. Then, in step S123, the first voltage controller 911 causes the detection voltage VT to be applied to the primary transfer roller 51*m*. In step S125, the first voltage controller 911 causes the low voltage VL to be applied to the other three primary transfer rollers 51*y*, 51*c*, and 51*k*. Next, in step S127, the current acquiring section 913 acquires the total current value JSm from the current detector 62. Next, in step S129, the resistance calculator 914 determines the resistance value Rm of the primary transfer roller 51*m* based on the detection voltage VT and the total current value JSm.

Next, in step S131, the second voltage controller 912 causes the light potential V21 to be applied to the photosensitive drum 42*k*. Then, in step S133, the first voltage controller 911 causes the detection voltage VT to be applied to the primary transfer roller 51*k*. In step S135, the first voltage controller 911 causes the low voltage VL to be applied to the other three primary transfer rollers 51*y*, 51*c*, and 51*m*. Next, in step S137, the current acquiring section 913 acquires the total current value JSk from the current detector 62. Next, in step S139, the resistance calculator 914 determines the resistance value Rk of the primary transfer roller 51*k* based on the detection voltage VT and the total current value JSk.

Figure 11:
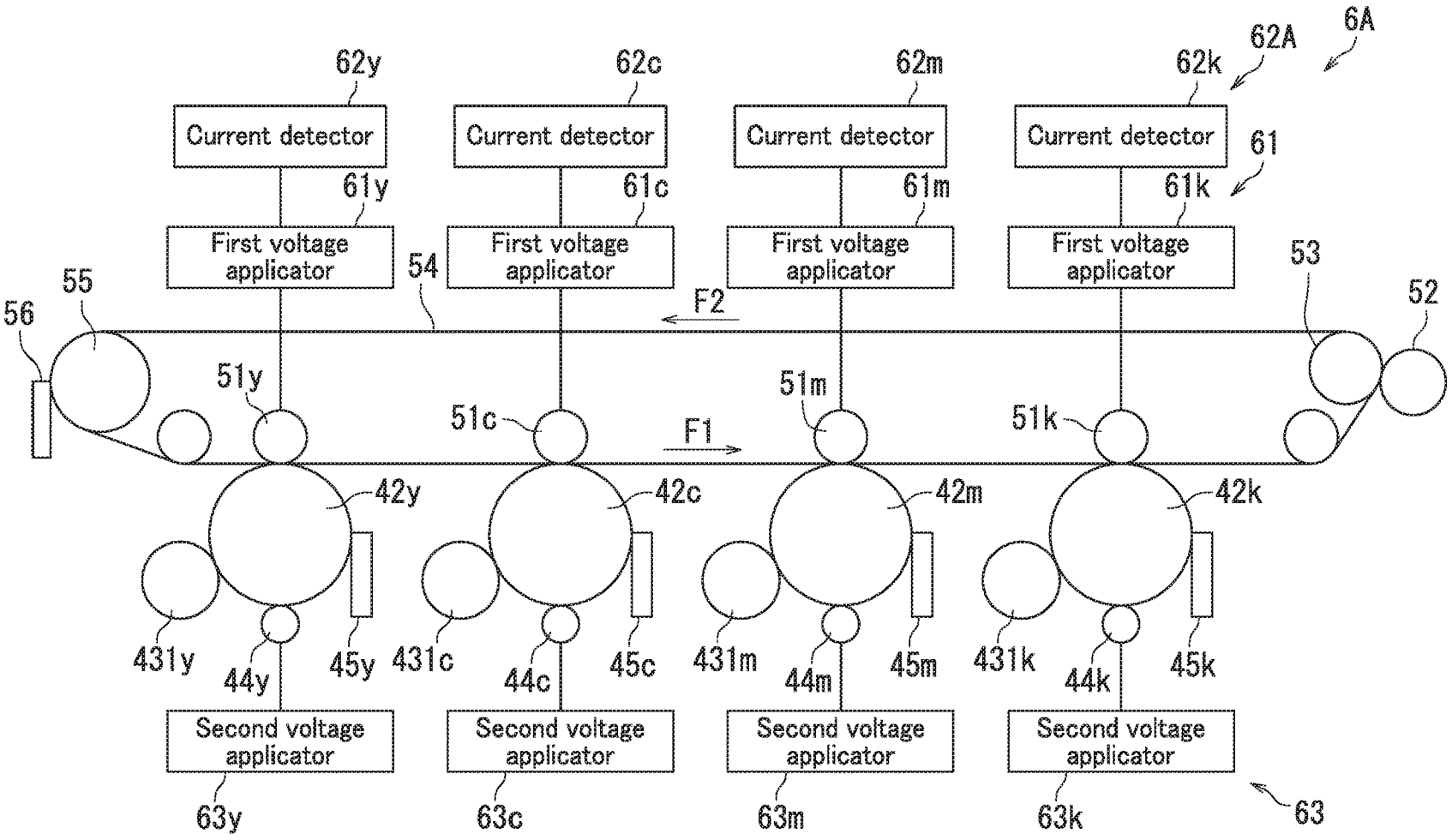
FIG. 11 is a diagram illustrating another example of the configuration of the power supply section.

The following describes a configuration of a power supply section 6A, which is another example of the power supply section 6, with reference to FIG. 11. FIG. 11 illustrates the configuration of the power supply section 6A. The power supply section 6A is different from the power supply section 6 illustrated in FIG. 3 in that the power supply section 6A includes current detectors 62*y*, 62*c*, 62*m*, and 62*k* respectively corresponding to the four first voltage applicators 61*y*, 61*c*, 61*m*, and 61*k*.

The power supply section 6A includes the first voltage applicators 61, current detectors 62A, and the second voltage applicators 63. The current detectors 62A include the current detectors 62*y*, 62*c*, 62*m*, and 62*k*. The current detectors 62*y*, 62*c*, 62*m*, and 62*k* respectively detects current values of currents Jy, Jc, Jm, and Jk flowing through the primary transfer rollers 51*y*, 51*c*, 51*m*, and 51*k*.

In a configuration including the four current detectors 62*y*, 62*c*, 62*m*, and 62*k* as illustrated in FIG. 11, the resistance values Ry, Rc, Rm, and Rk can be determined according to the following process. That is, first, the detection voltage VT having the voltage value VS is applied to each of the primary transfer rollers 51*y*, 51*c*, 51*m*, and 51*k*. Then, the current values of the currents Jy, Jc, Jm, and Jk are acquired. Next, the detection voltage VT having the voltage value V11 is applied to each of the primary transfer rollers 51*y*, 51*c*, 51*m*, and 51*k*. Then, the current values of the currents Jy, Jc, Jm, and Jk are acquired. Next, the detection voltage VT having the voltage value V12 is applied to each of the primary transfer rollers 51*y*, 51*c*, 51*m*, and 52*k*. Then, the current values of the currents Jy, Jc, Jm, and Jk are acquired. Next, the detection voltage VT having the voltage value V13 is applied to each of the primary transfer rollers 51*y*, 51*c*, 51*m*, and 52*k*. Then, the current values of the currents Jy, Jc, Jm, and Jk are acquired. Furthermore, the resistance values Ry, Rc, Rm, and Rk of the primary transfer rollers 51*y*, 51*c*, 51*m*, and 51*k* are determined based on the voltage values VS, V11, V12, and V13 of the detection voltage VT and on the corresponding current values of the currents Jy, Jc, Jm, and Jk. In a configuration including the current detectors 62*y*, 62*c*, 62*m*, and 62*k*, therefore, the resistance values Ry, Rc, Rm, and Rk can be determined quickly.

As described above with reference to FIGS. 3 to 10, the second voltage controller 912 causes a voltage having a smaller absolute value than the dark potential V22 of each photosensitive drum 42 to be applied to the photosensitive drum 42 during the transfer voltage control period. Thus, the time required to charge the photosensitive drum 42 can be reduced. Since a voltage having a smaller absolute value than the dark potential V22 is applied to the photosensitive drum 42, error of measurement of the resistance value R of the corresponding primary transfer roller 51 can be reduced. As a result, the time needed before printing is started can be reduced.

In a configuration in which the photosensitive drums 42 include an organic photoconductor as a photosensitive member, the second voltage controller 912 causes a voltage substantially equal to the light potential V21 of each photosensitive drum 42 to be applied to the photosensitive drum 42 during the transfer voltage control period. The light potential V21 has a smaller absolute value than the dark potential V22. Thus, the time required to charge the photosensitive drum 42 can be reduced. Furthermore, error of measurement of the resistance value R of the corresponding primary transfer roller 51 can be reduced. Thus, the time needed before printing is started is reliably reduced in a configuration in which the photosensitive drums 42 include an organic photoconductor as a photosensitive member.

In a configuration in which the photosensitive drums 42 include an amorphous silicon photoconductor as a photosensitive member, the second voltage controller 912 causes no voltage to be applied to each photosensitive drum 42 during the transfer voltage control period. Thus, the time required to charge the photosensitive drum 42 can be reduced. Furthermore, error of measurement of the resistance value R of the corresponding primary transfer roller 51 can be reduced. Thus, the time needed before printing is started can be reliably reduced in a configuration in which the photosensitive drums 42 include an amorphous silicon photoconductor as a photosensitive member.

Furthermore, the first voltage applicators 61 respectively apply voltages to a specified number of (for example, four) primary transfer rollers 51 (51*y*, 51*c*, 51*m*, and 51*k*). Furthermore, the current detector 62 detects the total current values JS (JSy, JSc, JSm, and JSk), each of which is a sum of values of the currents flowing through the four respective primary transfer rollers 51.

Thus, the resistance values Ry, Rc, Rm, and Rk of the four primary transfer rollers 51 can be determined only with one current detector 62. More specifically, for example, the first voltage applicators 61 apply the detection voltage VT to the primary transfer roller 51*y*, which is one of the four primary transfer rollers 51, and apply no voltage to the other primary transfer rollers 51*c*, 51*m*, and 51*k* to detect the total current value JS. The resistance value Ry of the primary transfer roller 51*y* to which the detection voltage VT has been applied can be determined by dividing the voltage value of the detection voltage VT by the total current value JS. The resistance values R of the four primary transfer rollers 51 can be determined through the first voltage applicators 61 applying the detection voltage VT to the four primary transfer rollers 51 in order. Thus, the number of current detectors 62 for detecting the current values of the currents flowing through the primary transfer rollers 51 can be reduced. As a result, the manufacturing cost of the image forming apparatus 1 can be reduced.

Furthermore, when the first voltage controller 911 causes the detection voltage VT to be applied to the primary transfer roller 51*y*, which is one of the four primary transfer rollers 51, the low voltage VL having the same polarity as the detection voltage VT is applied to the other primary transfer rollers 51*c*, 51*m*, and 51*k*. In this case, the detection voltage VT is a voltage that is applied for detecting the resistance value Ry of the primary transfer roller 51*y*. The value of the detection voltage VT is a predetermined voltage value (for example, 500 V). The low voltage VL has a smaller absolute value than the detection voltage VT. By applying the voltage having the same polarity as the detection voltage VT to the other primary transfer rollers 51*c*, 51*m*, and 51*k*, it is possible to reduce leakage of current from the one primary transfer roller 51*y* to the other primary transfer rollers 51*c*, 51*m*, and 51*k*. Thus, the resistance value Ry of the primary transfer roller 51*y* can be detected accurately. Likewise, the resistance values Rc, Rm, and Rk can be detected accurately. Through the above, transfer voltages each having an appropriate magnitude can be applied to the four primary transfer rollers 51.

When the first voltage controller 911 causes the detection voltage VT to be applied to the primary transfer roller 51*y*, which is one of the four primary transfer rollers 51, the low voltage VL is applied to the other primary transfer rollers 51*c*, 51*m*, and 51*k*. The voltage value of the low voltage VL is at least one-200th of the voltage value of the detection voltage VT. Thus, current flowing from the primary transfer roller 51*y* into the primary transfer rollers 51*c*, 51*m*, and 51*k* can be reduced. Furthermore, the voltage value of the low voltage VL that is applied to the other primary transfer rollers 51*c*, 51*m*, and 51*k* is not greater than one-tenth of the voltage value of the detection voltage VT. Thus, current flowing into the primary transfer rollers 51*c*, 51*m*, and 51*k* can be reduced. As a result, the resistance value Ry of the primary transfer roller 51*y* can be detected more accurately. Likewise, the resistance values Rc, Rm, and Rk can be detected more accurately. Consequently, transfer voltages each having a more appropriate magnitude can be applied to the four primary transfer rollers 51.

Additionally or alternatively, the resistance calculator 914 determines the resistance value Ry of the primary transfer roller 51*y* based on the plurality of (for example, four) voltage values VS, V11, V12, and V13 of the detection voltage VT that is applied to the one primary transfer roller 51*y* and on the total current values JSy. Likewise, the resistance values Rc, Rm, Rk of the other primary transfer rollers 51*c*, 51*m*, and 51*k* are determined. Thus, the resistance values R of the primary transfer rollers 51 can be determined accurately. More specifically, the resistance value R of each of the four primary transfer rollers 51 can be determined more accurately by for example determining a straight line representing a relationship between the voltage values of the detection voltage VT and the total current values JS, and determining the inverse of the slope of the straight line. Through the above, transfer voltages each having an appropriate magnitude can be applied to the four primary transfer rollers 51.

Through the above, an embodiment of the present disclosure has been described with reference to the drawings. However, the present disclosure is not limited to the above embodiment and may be implemented in various different forms that do not deviate from the essence of the present disclosure (for example, as described below in sections (1) to (8). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiment, such as shapes and dimensions, are merely examples and are not intended as specific limitations. Various alterations may be made so long as there is no substantial deviation from the configuration of the present disclosure.

(1) The present disclosure is described with reference to FIG. 1 for a configuration in which the image forming apparatus 1 includes the four primary transfer rollers 51*c*, 51*m*, 51*y*, and 51*k* and the four photosensitive drums 42*c*, 42*m*, 42*y*, and 42*k*. However, the present disclosure is not limited to such a configuration. No particular limitations are placed on the number of primary transfer rollers and the number of photosensitive drums so long as the image forming apparatus 1 includes one or more primary transfer rollers and photosensitive drums. For example, the image forming apparatus 1 may include one, two, three, or five or more primary transfer rollers and photosensitive drums.

(2) The present disclosure is described with reference to FIG. 4 for a configuration in which the value of the low voltage VL is from one-200th to one-tenth of the voltage value of the detection voltage VT. However, the present disclosure is not limited to such a configuration. No particular limitations are placed on the low voltage VL so long as the low voltage VL has the same polarity as the detection voltage VT and has a smaller absolute value than the detection voltage VT.

(3) The present disclosure is described with reference to FIGS. 6A and 6B for a configuration in which the second voltage controller 912 causes the light potential V21 to be applied to the charging roller 44*y*. However, the present disclosure is not limited to such a configuration. In a preferable configuration, the second voltage controller 912 causes a voltage that is from 80% to 120% of the light potential V21 to be applied to the charging roller 44*y*. In a more preferable configuration, the second voltage controller 912 causes a voltage that is from 90% to 110% of the light potential V21 to be applied to the charging roller 44*y*.

(4) The present disclosure is described with reference to FIGS. 6A and 6B for a configuration in which the first voltage controller 911 causes the detection voltage VT to be applied to the four primary transfer rollers 51*y*, 51*c*, 51*m*, and 51*k* in the noted order. However, the present disclosure is not limited to such a configuration. The first voltage controller 911 may cause the detection voltage VT to be applied to the primary transfer rollers 51 in any order. In a configuration, for example, the detection voltage VT may be applied to the four primary transfer rollers 51*k*, 51*m*, 51*c*, and 51*y* in the noted order.

(5) The present disclosure is described with reference to FIGS. 6A and 6B for a configuration in which the first voltage controller 911 causes a negative voltage to be applied to each primary transfer roller 51 during printing. However, the present disclosure is not limited to such a configuration. In a configuration, the first voltage controller 911 may cause a positive voltage to be applied to each primary transfer roller 51 during printing. In such a configuration, toners that are supplied to the photosensitive drums 42 are negatively charged.

(6) The present disclosure is described with reference to FIGS. 7A and 7B for a configuration in which the second voltage controller 912 causes no voltage to be applied to the charging roller 44*y*. However, the present disclosure is not limited to such a configuration. In a preferable configuration, the second voltage controller 912 causes a voltage having an absolute value that is no greater than 10% of the absolute value of the dark potential V22A to be applied to the charging roller 44*y*. In a more preferable configuration, the second voltage controller 912 causes a voltage having an absolute value that is no greater than 5% of the absolute value of the dark potential V22A to be applied to the charging roller 44*y*.

(7) The present disclosure is described with reference to FIG. 8 for a configuration in which the resistance calculator 914 determines the inverse of the slope of the straight line in the graph G3. However, the present disclosure is not limited to such a configuration. In a configuration, the resistance calculator 914 may obtain a curve that approximates coordinates of the measurement points PT instead of the straight line in the graph G3. In such a configuration, the resistance value R is determined as the inverse of the slope of the curve.

(8) The present disclosure is described with reference to FIG. 3 for a configuration including one current detector 62. The present disclosure is also described with reference to FIG. 11 for a configuration in which the current detectors 62A include the four current detectors 62*y*, 62*c*, 62*m*, and 62*k*. However, the present disclosure is not limited to such configurations. For example, a configuration including two current detectors may be adopted. More specifically, one of the two current detectors detects a sum of values of currents flowing through the primary transfer roller 51*y* and the primary transfer roller 51*c*. The other current detector detects a sum of values of currents flowing through the primary transfer roller 51*m* and the primary transfer roller 51*k*. In such a configuration, the resistance values Ry, Rc, Rm, and Rk can be determined more quickly than in the configuration illustrated in FIG. 3. Furthermore, the manufacturing cost can be reduced more in such a configuration than in the configuration illustrated in FIG. 11.

What is claimed is:

1. An image forming apparatus for forming an image on a recording medium, comprising:

a photosensitive drum on which a toner image is formed;

a primary transfer roller disposed opposite to the photosensitive drum;

a first voltage applicator that applies a voltage to the primary transfer roller;

a first voltage controller configured to control the voltage that is applied to the primary transfer roller through the first voltage applicator;

a current detector that detects a current value of a current flowing through the primary transfer roller;

a charging roller configured to charge the photosensitive drum;

a second voltage applicator that applies a voltage to the charging roller; and a second voltage controller configured to control the voltage that is applied to the charging roller through the second voltage applicator, wherein the second voltage controller causes a voltage having a smaller absolute value than a dark potential of the photosensitive drum to be applied to the photosensitive drum during a transfer voltage control period, the first voltage controller causes a voltage to be applied to the primary transfer roller during the transfer voltage control period, the current detector detects a current value of a current flowing through the primary transfer roller during the transfer voltage control period, the transfer voltage control period is a duration of time in which a resistance value of the primary transfer roller is determined prior to printing, the photosensitive drum includes an organic photoconductor as a photosensitive member, and the second voltage controller causes a voltage that is equal to a light potential of the photosensitive drum to be applied to the photosensitive drum during the transfer voltage control period.

2. The image forming apparatus according to claim 1, wherein the second voltage controller causes a dark potential of the photosensitive drum to be applied to the photosensitive drum and causes the photosensitive drum to be exposed to light for printing at 100% coverage thereby to apply the voltage that is equal to the light potential to the photosensitive drum.

3. The image forming apparatus according to claim 1, comprising:

a specified number of the photosensitive drums, the specified number being two or more;

the specified number of the primary transfer rollers;

the specified number of the first voltage applicators;

the specified number of the charging rollers; and an intermediate transfer belt held between the specified number of the photosensitive drums and the specified number of the primary transfer rollers, wherein the current detector detects a current value of a current flowing through each of the specified number of the primary transfer rollers.

4. The image forming apparatus according to claim 3, further comprising:

a resistance calculator configured to determine a resistance value of each of the specified number of the primary transfer rollers, the first voltage controller causes a detection voltage to be applied to each of the specified number of the primary transfer rollers, the detection voltage being varied to have a plurality of different voltage values, the current detector detects a plurality of the current values respectively corresponding to the plurality of different voltage values, and the resistance calculator determines the resistance value based on the plurality of different voltage values and the plurality of the current values.

5. An image forming apparatus for forming an image on a recording medium, comprising:

a photosensitive drum on which a toner image is formed;

a primary transfer roller disposed opposite to the photosensitive drum;

a first voltage applicator that applies a voltage to the primary transfer roller;

a first voltage controller configured to control the voltage that is applied to the primary transfer roller through the first voltage applicator;

a current detector that detects a current value of a current flowing through the primary transfer roller;

a charging roller configured to charge the photosensitive drum;

a second voltage applicator that applies a voltage to the charging roller; and a second voltage controller configured to control the voltage that is applied to the charging roller through the second voltage applicator, wherein the second voltage controller causes a voltage having a smaller absolute value than a dark potential of the photosensitive drum to be applied to the photosensitive drum during a transfer voltage control period, the first voltage controller causes a voltage to be applied to the primary transfer roller during the transfer voltage control period, the current detector detects a current value of a current flowing through the primary transfer roller during the transfer voltage control period, the transfer voltage control period is a duration of time in which a resistance value of the primary transfer roller is determined prior to printing, the photosensitive drum includes an amorphous silicon photoconductor as a photosensitive member, and the second voltage controller causes a voltage that is equal to a light potential of the photosensitive drum to be applied to the photosensitive drum during the transfer voltage control period.

6. The image forming apparatus according to claim 5, wherein the second voltage controller causes no voltage to be applied to the photosensitive drum during the transfer voltage control period.

7. The image forming apparatus according to claim 5, wherein the second voltage controller keeps the photosensitive drum from being charged during the transfer voltage control period.

8. An image forming apparatus for forming an image on a recording medium, comprising:

a photosensitive drum on which a toner image is formed;

a primary transfer roller disposed opposite to the photosensitive drum;

a first voltage applicator that applies a voltage to the primary transfer roller;

a first voltage controller configured to control the voltage that is applied to the primary transfer roller through the first voltage applicator;

a current detector that detects a current value of a current flowing through the primary transfer roller;

a charging roller configured to charge the photosensitive drum;

a second voltage applicator that applies a voltage to the charging roller; and a second voltage controller configured to control the voltage that is applied to the charging roller through the second voltage applicator, wherein the second voltage controller causes a voltage having a smaller absolute value than a dark potential of the photosensitive drum to be applied to the photosensitive drum during a transfer voltage control period, the first voltage controller causes a voltage to be applied to the primary transfer roller during the transfer voltage control period, the current detector detects a current value of a current flowing through the primary transfer roller during the transfer voltage control period, the transfer voltage control period is a duration of time in which a resistance value of the primary transfer roller is determined prior to printing, the image forming apparatus comprises:

a specified number of the photosensitive drums, the specified number being two or more;

the specified number of the primary transfer rollers;

the specified number of the first voltage applicators;

the specified number of the charging rollers; and an intermediate transfer belt held between the specified number of the photosensitive drums and the specified number of the primary transfer rollers, the current detector detects a total current value, the total current value being a sum of current values of currents flowing through the specified number of the primary transfer rollers, the image forming apparatus further comprises a resistance calculator configured to determine a resistance value of any of the specified number of the primary transfer rollers, the first voltage controller causes a detection voltage to be applied to one primary transfer roller of the specified number of the primary transfer rollers and causes a low voltage to be applied to all other of the primary transfer rollers, the detection voltage being varied to have a plurality of different voltage values, the low voltage having the same polarity as the detection voltage, the low voltage has a smaller absolute value than the detection voltage, the current detector detects a plurality of the total current values respectively corresponding to the plurality of different voltage values, and the resistance calculator determines the resistance value of the one primary transfer roller based on the plurality of different voltage values and the plurality of the total current values.

* * * * *